US005348493A

United States Patent [19]

Power

[11] Patent Number: 5,348,493

[45] Date of Patent: Sep. 20, 1994

[54] LOCK DEVICE FOR CONNECTOR

[75] Inventor: Michael M. Power, Shizuoka, Japan

[73] Assignee: Yazaki Corporation, Tokyo, Japan

[21] Appl. No.: 972,629

[22] Filed: Nov. 6, 1992

[30] Foreign Application Priority Data

Nov. 11, 1991 [JP] Japan ..... 3-294167

[51] Int. Cl.[5] ..... H01R 13/627

[52] U.S. Cl. ..... 439/352; 439/350

[58] Field of Search ..... 439/350–355, 439/357, 358, 347, 488, 489

[56] References Cited

U.S. PATENT DOCUMENTS

| | | | |
|---|---|---|---|
| 4,370,013 | 1/1983 | Niitsu et al. | 439/352 |
| 4,634,204 | 1/1987 | Detter et al. | 439/352 |
| 4,708,413 | 11/1987 | Schroeder | 439/352 |
| 4,884,978 | 12/1989 | Inaba et al. | 439/352 |
| 4,950,179 | 8/1990 | Takenouchi et al. | 439/352 |
| 4,993,967 | 2/1991 | Matsumoto | 439/352 |
| 5,041,017 | 8/1991 | Nakazato et al. | 439/352 |
| 5,192,225 | 3/1993 | Suzuki | 439/352 |

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

This invention relates to a construction in which an incomplete locking connection between a pair of connector housings is detected by a lock release member. According to the present invention, a cantilever-type flexible locking arm extending forward is provided on a male connector housing, and a lock engagement portion for the flexible locking arm is provided on a female connector housing. A lock release member having a lock release arm is mounted on the female connector housing so as to slide in a forward/rearward direction, and in an incompletely-fitted condition, the lock release member is engaged with the flexible locking arm to be prevented from moving to a predetermined position.

8 Claims, 4 Drawing Sheets

LOCK DEVICE FOR CONNECTOR

BACKGROUND OF THE INVENTION

This invention relates to a lock device in which a cantilever-type locking arm provided on one connector housing is engaged with the other connector housing, and a lock release member provided on the other connector housing is operated to release the engagement of the locking arm to thereby release the connection between the pair of connector housings.

In FIG. 6 (Japanese Utility Model Publication No. 57-545), a cantilever-type locking arm c is provided on each of opposite side walls h of a male connector a, and extends rearward from an upstanding proximal portion d disposed at a forward side in the direction of fitting of the male connector a. A retaining projection e is formed on the free end portion of the locking arm c.

A guide groove h for the locking arm c is formed in each of opposite side walls g of a female connector f, and a notch i is provided in the groove h, and extends in a forward/backward direction. The notch i forms a retaining portion j for the retaining projection e. A release arm l is provided outwardly of the notch i, and extends forwardly from an upstanding proximal portion k at a rearward side in the direction of fitting of the female connector f. A push projection m is formed on the distal end of the release arm l in facing relation to the notch i.

In the above construction, when the male connector a is fitted in the female connector f, the locking arm c is inserted into the guide groove h, and the retaining projection e is engaged with the side wall g, so that the locking arm c moves in an elastically inwardly deformed condition. When the retaining projection e passes past the side wall g to reach the notch i, the locking arm is restored, so that the retaining projection e is engaged in the retaining portion j (FIG. 7). Upon restoration of the locking arm c, an impingement portion n at its distal end impinges on the inner surface of the side wall g, and this impingement sound is well transmitted to the exterior through the notch i. A complete fitting between the male and female connectors a and f is aurally confirmed through this impingement sound.

For releasing the condition of fitting between the male and female connectors a and f, the free end of the release arm l is pushed down to urge the retaining projection e by the push projection m to push down the locking arm c, and the retaining projection e is disengaged from the notch i, and then the male and female connectors a and f are disengaged from each other.

In the above prior art, the complete fitting between the male and female connectors a and f is aurally confirmed, and therefore in some environments of the operation, it is difficult to obtain this confirmation.

SUMMARY OF THE INVENTION

With the foregoing in view, it is an object of this invention to provide a construction in which a complete fitting between pair of connector can be easily confirmed by a lock release member.

The above object has been achieved by a construction wherein a cantilever-type flexible locking arm extending forward is provided on one connector housing; a lock engagement portion for said flexible locking arm is provided on the other connector housing; a lock release member having a lock release arm is mounted on said other connector housing so as to slide in a forward-/rearward direction; and in an incompletely-fitted condition, said lock release member is engaged with said flexible locking arm to be prevented from moving to a predetermined position.

When the pair of connector housings are in their completely-fitted condition, the lock release member can move to the predetermined position. The lock can be released by pressing the lock release arm to drive the flexible locking arm.

DETAILED DESCRIPTION OF THE PREFERRED EMBODIMENT

In FIGS. 1 to 5, each of a male connector housing A, a female connector housing B and a lock release member C is integrally formed of a synthetic resin material. Each of the male and female connector housings A and B has a plurality of terminal receiving chambers, and contains metal terminals, the metal terminals of these two connector housings being connected together.

A flexible locking arm 2 of the cantilever type, which has a proximal portion **2*b* at a rear side and extends forward, is provided in a groove 1 formed in the upper surface of the male connector housing A, with a gap G formed between the locking arm 2 and a surface 3**.

Figure 1:
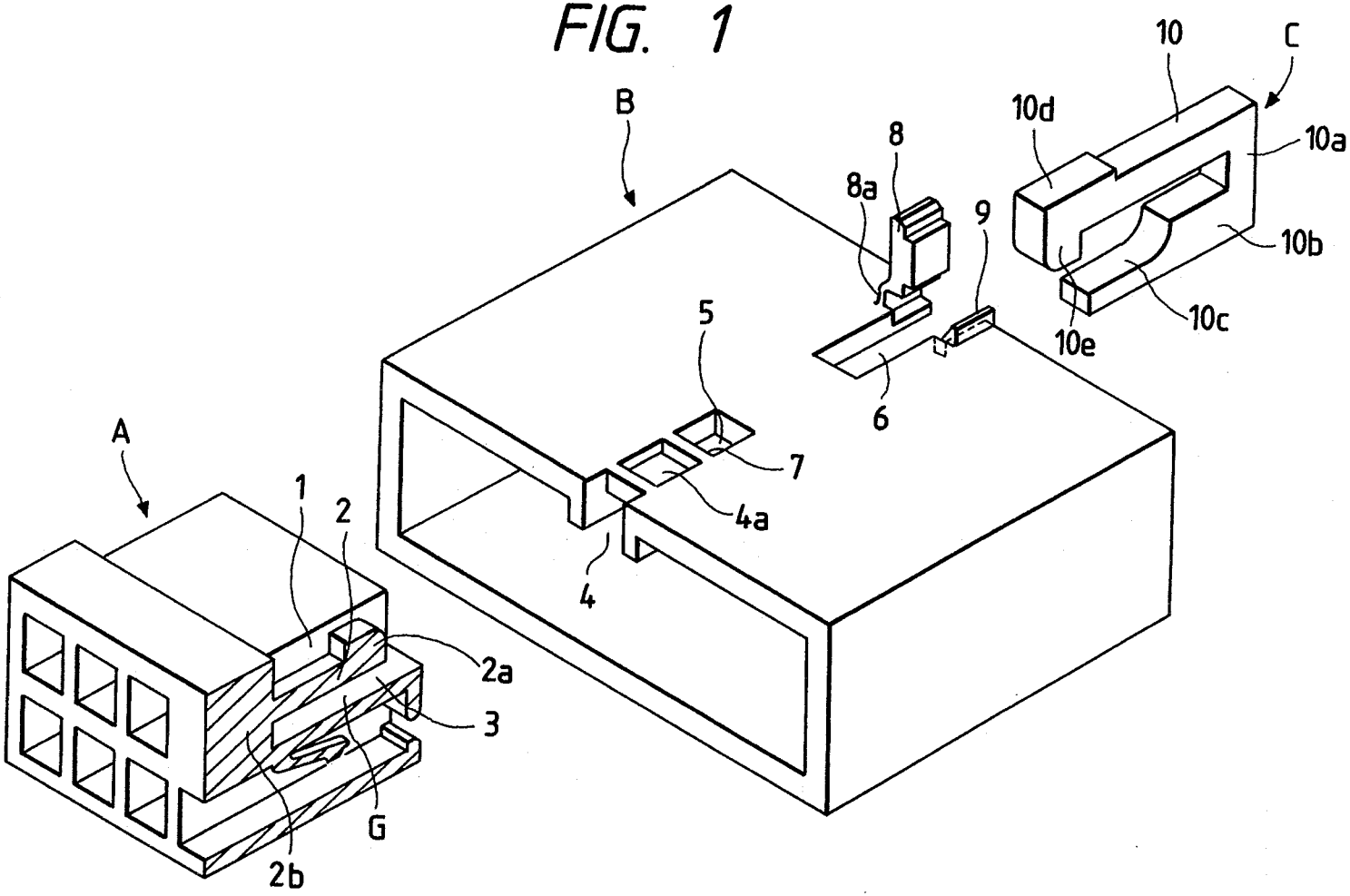
FIG. 1 is an exploded, perspective view of one preferred embodiment of the present invention.
Figure 2:
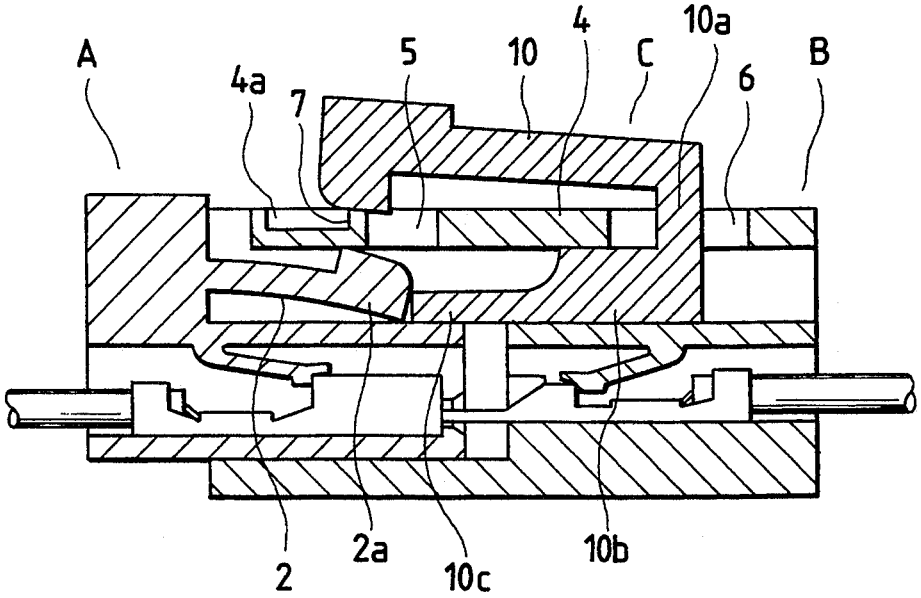
FIG. 2 is a cross-sectional view showing the process of a connecting operation in the above embodiment.

A bulge frame portion 4 for receiving the flexible locking arm 2 is provided at that portion of the upper wall of the female connector housing B corresponding to the flexible locking arm 2. A lock release hole 5 and a mounting hole 6 are formed through the bulge frame portion 4 of the female connector housing B, as shown in FIGS. 1 and 2. The lock release hole receives a retaining projection **2*a* of the locking arm 2 and allows for the release thereof. A front edge portion of the lock release hole 5 defines a lock engagement portion 7. The mounting hole 6** is for receiving the lock release member C.

An openable closure plate portion 8 is provided at the rear portion of the mounting hole 6 at the bulge frame portion 4, and has a hinge portion **8*a* integral with one side edge of the mounting hole 6. The free end of the openable closure plate portion 8 is held in a closed condition by a retaining portion 9**.

Referring to the lock release member C, a slide portion **10*b* is connected via a connection portion 10*a* to a lock release arm 10, so that the lock release member C is formed into a generally U-shape. The front end portion of the slide portion 10*b* is thinned, and this thinned portion serves as an incomplete lock detection/lock connection hold portion 10*c***. A manipulation projection 10*d* is formed at the free end of the lock release arm 10, and a push projection 10*e* is formed on the lower side of the manipulation projection 10*d*.

In the open condition of the openable closure plate portion 8, the lock release member C is attached to the female connector housing B from the rear side thereof in straddling relation to the bulge frame portion 4 so as to slide along the bulge frame portion 4. The lock release member C is normally urged forwardly by a spring (not shown). Provisional retaining means may be provided for preventing the lock release member C from easily sliding.

In the above construction, when the male connector housing A is fitted into the female connector housing B, a retaining projection 2*a* of the flexible locking arm 2 impinges on the front end of the bulge frame portion 4 to be displaced downward, and advances in contact with the incomplete lock detection/lock connection hold portion 10*c* to retract the lock release member C (FIG. 2).

Figure 3:
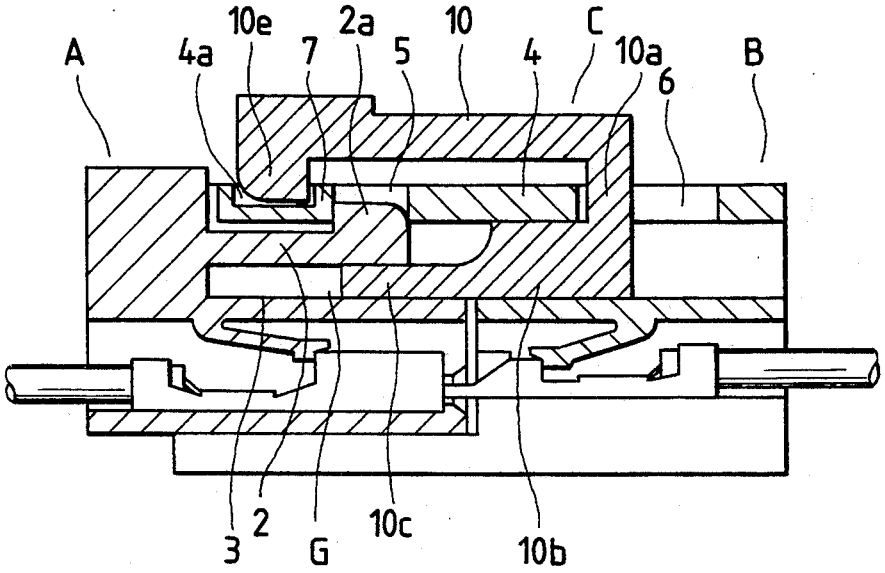
FIG. 3 is a cross-sectional view showing a completely connected condition in the above embodiment.
Figure 4:
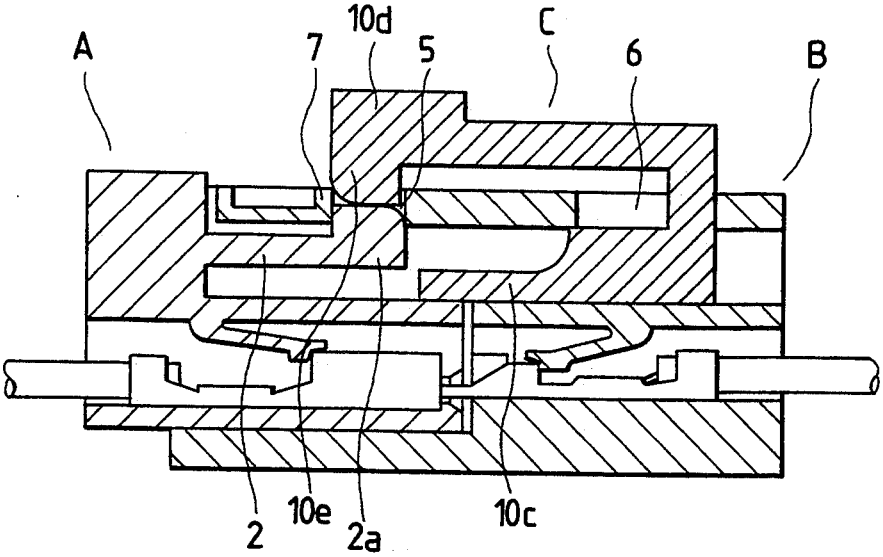
FIG. 4 is a cross-sectional view showing the process of a lock releasing operation in the above embodiment.

When the male connector housing A reaches the complete fitting position, the retaining projection 2*a* reaches the lock release hole 5 to be restored, so that the retaining projection 2*a* is brought into locking engagement with the lock engagement portion 7. In this condition, the lock release member C is pushed forward to engage the push projection 10*e* in a recess 4*a* in the front end portion of the bulge frame portion 4 to thereby fix the lock release member C. At this time, the incomplete lock detection/lock connection hold portion is introduced into the gap G to prevent the displacement of the flexible locking arm 2, thereby insuring that the connector housings will remain locked to each other (FIG. 3).

Figure 5:
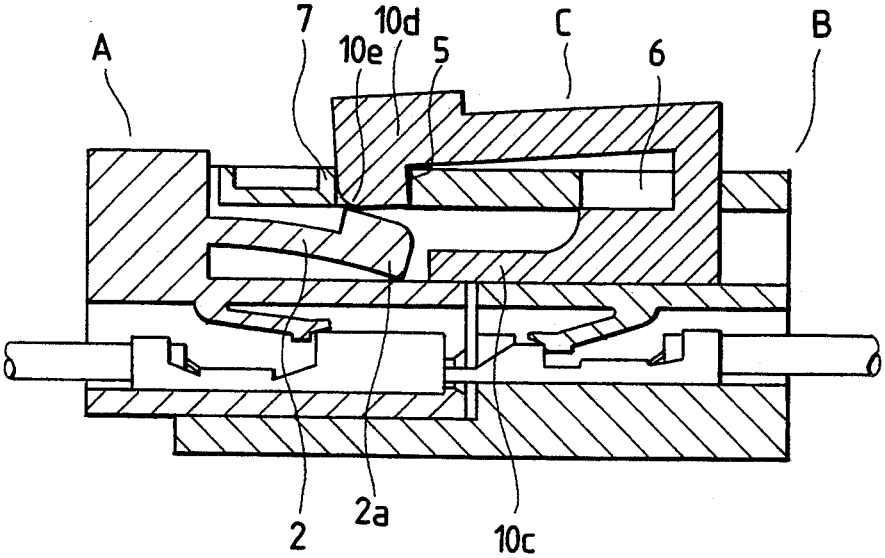
FIG. 5 is a cross-sectional view showing a lock released condition in the above embodiment.
Figure 6:
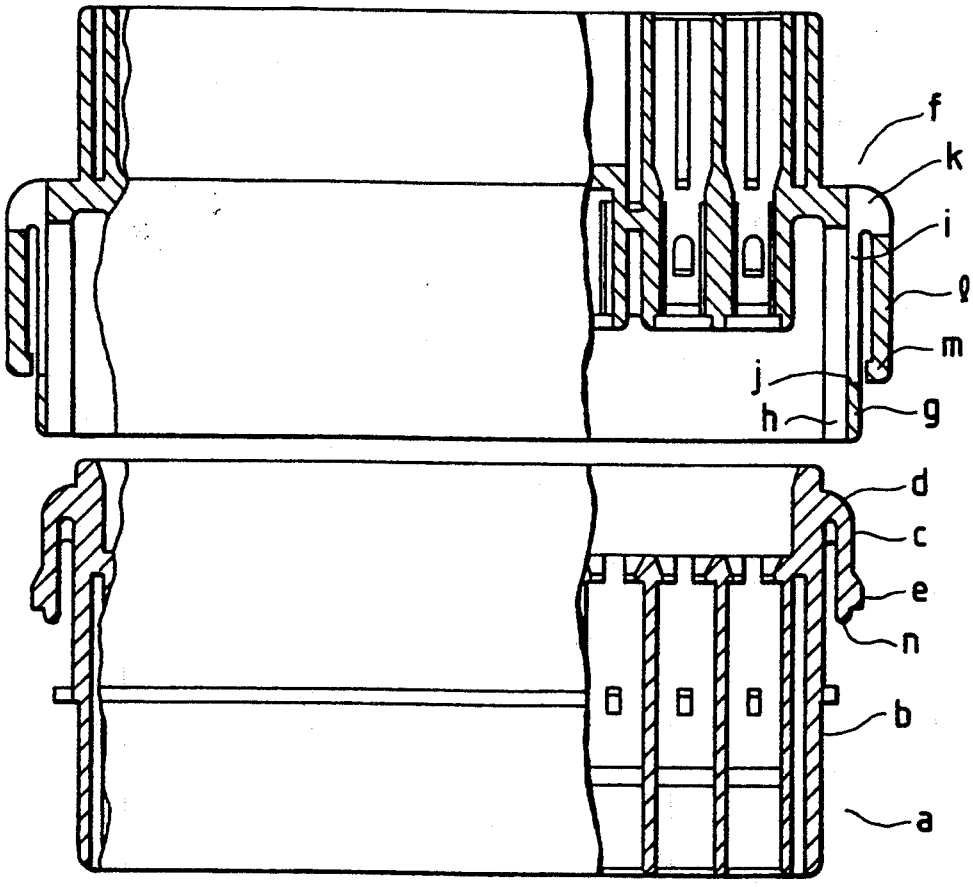
FIG. 6 PRIOR ART
FIG. 6 is a cross-sectional view of the conventional art, showing male and female connectors in their separated condition.
Figure 7:
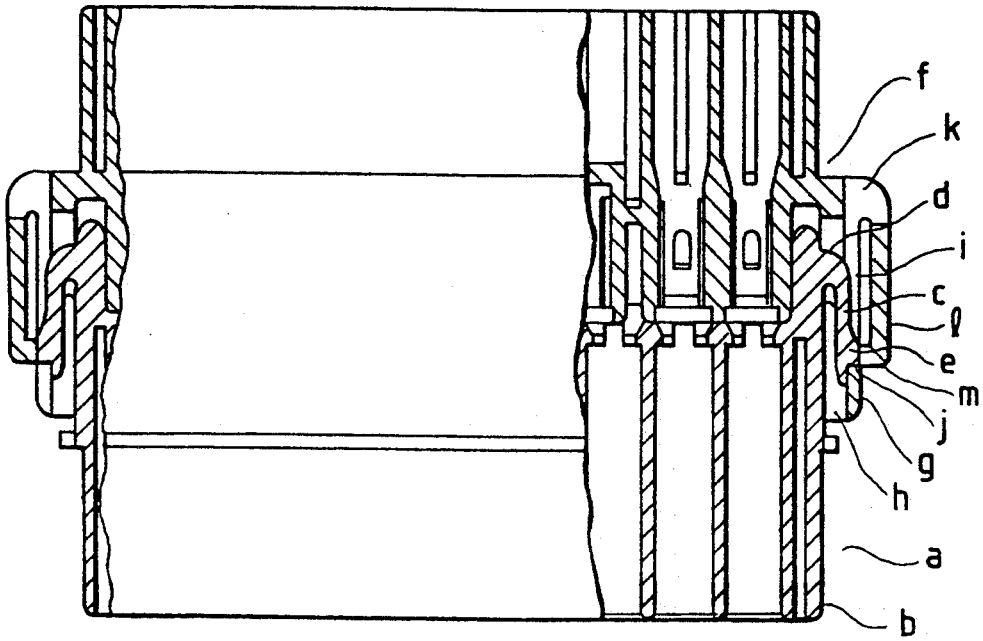
FIG. 7 PRIOR ART
FIG. 7 is a cross-sectional view showing a connected condition in the above conventional art.

For disengaging the male and female connector housings A and B from each other, the lock release member C is retracted, and the push projection 10*e* of the lock release arm 10 is disposed in registry with the retaining projection 2*a* of the flexible locking arm 2 (FIG. 4), and the lock release arm 10 is depressed to disengage the retaining projection 2*a* of the flexible locking arm 2 from the lock engagement portion 7, and in this condition the connector housings are moved away from each other (FIG. 5).

As described above, in the present invention, there is provided the construction wherein the cantilever-type flexible locking arm extending forward is provided on one connector housing, the lock engagement portion for the flexible locking arm is provided on the other connector housing, the lock release member having the lock release arm is mounted on the other connector housing so as to slide in the forward/rearward direction, and in the incompletely-fitted condition, the lock release member is engaged with the flexible locking arm to be prevented from moving to the predetermined position. Therefore, by pressing the lock release member, the locking connection between the pair of connector housings can be easily released. And besides, from the position of movement of the lock release member, the complete connection between the pair of connector housings can be easily confirmed.

What is claimed is:

1. A connector, comprising:

a pair of connector housings adapted to be engaged with each other, one of said connector housings including a flexible lock arm extending forwardly therefrom and the other connector housing having lock engaging means which is engaged by said lock arm when said connector housing are in a completely fitted condition; and a lock release member slidably disposable in said other connector housing, said lock release member including a lock release arm for disengaging said lock arm of said one connector housing from said lock engaging means of said other connector housing to allow for said connector housings to be disengaged from each other, wherein when said connector housings are in an incompletely-fitted condition where said lock arm is not engaged with said engaging means, a portion of said lock release member abuts against said lock arm so as to be prevented from moving to a predetermined position indicating said incompletely-fitted condition.

2. The connector of claim 1, wherein said lock release member is moveable to said predetermined position when said lock arm of said one connector housing is engaged with said engaging means wherein when said connector housings are in an incompletely-fitted condition where said lock arm is not engaged with said engaging means, a portion of said lock release member abuts against said lock arm so as to be prevented from moving to predetermined position indicating said incompletely-fitted condition.

3. The connector of claim 1, wherein said lock release member includes preventing means for preventing said lock arm of said one connector housing from being disengaged from said engaging means when said lock release member is in said predetermined position.

4. The connector of claim 3, wherein said lock release arm is engageable with said other connector housing when said lock release member is in said predetermined position.

5. The connector of claim 3, wherein when said connector housings are in an incompletely-fitted condition where said lock arm is not engaged with said engaging means, said lock release member is prevented from being moved to said predetermined position by said lock arm indicating said incompletely-fitted condition.

6. The connector of claim 1, wherein said other connector housing has a slot for receiving said lock release member.

7. The connector of claim 1, wherein said lock release member is substantially U-shaped, said portion of said lock release arm being an end of one leg defining said U-shape.

8. The connector of claim 7, wherein the other leg of said lock release member is engagable with said other connector housing when said lock arm is engaged with said engaging means.

* * * * *